United States Patent [19]

Takano

[11] 4,122,812

[45] Oct. 31, 1978

[54] EXHAUST GAS RECIRCULATION APPARATUS FOR AN INTERNAL COMBUSTION ENGINE

[75] Inventor: Yuuichi Takano, Toyota, Japan

[73] Assignee: Toyota Jidosha Kogyo Kabushiki Kaisha, Toyota, Japan

[21] Appl. No.: 756,858

[22] Filed: Jan. 5, 1977

[30] Foreign Application Priority Data

Oct. 19, 1976 [JP] Japan ..... 51-139573[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,882,837 | 5/1975 | Horie et al. | 123/119 A |
| 3,906,909 | 9/1975 | Garcea | 123/119 A |
| 3,908,618 | 9/1975 | Tange et al. | 123/119 A |
| 4,024,847 | 5/1977 | Koganemaru | 123/119 A |
| 4,048,967 | 9/1977 | Stumpp | 123/119 A |
| 4,061,119 | 12/1977 | Takeshita | 123/119 A |

*Primary Examiner*—Wendell E. Burns

*Attorney, Agent, or Firm*—Stevens, Davis, Miller & Mosher

[57] ABSTRACT

Disclosed is an exhaust gas recirculation apparatus for an internal combustion engine, by which the exhaust gas from a vacuum operated flow control valve connected to the exhaust system of the engine is recirculated into the intake system of the engine at a position located upstream of the throttle valve or at a position located downstream of the throttle valve in accordance with engine operating conditions. The exhaust gas is recirculated at the position downstream of the throttle valve when the engine is operating under a low rotational speed condition, while the exhaust gas is recirculated at the position upstream of the throttle valve when the engine is operating under a high rotational speed condition. A sufficient amount of exhaust gas can be recirculated during all engine operating conditions.

5 Claims, 5 Drawing Figures

EXHAUST GAS RECIRCULATION APPARATUS FOR AN INTERNAL COMBUSTION ENGINE

FIELD OF THE INVENTION

The present invention relates to an exhaust gas recirculation (EGR) apparatus for an internal combustion engine.

BACKGROUND OF THE INVENTION

Known EGR apparatuses for suppressing nitrogen oxide ($NO_x$) emission from an internal combustion engine are divided into two types. In the first type of EGR apparatus, the exhaust gas is recirculated into the intake system of the engine at a position located upstream of the throttle valve. In the second type of EGR apparatus, the exhaust gas is recirculated into the engine intake system at a position located downstream of the throttle valve. In these known EGR apparatuses it is desired to recirculate a sufficient amount of exhaust gas for reducing to a great extent the amount of the $NO_x$ emission, due to the strict regulations directed against exhaust pollution from engines, which is undoubtedly a great public nuisance.

However, the above-mentioned first type EGR apparatus, in which the exhaust gas is recirculated into the intake system at the position upstream of the throttle valve, suffers from the shortcoming that a sufficient amount of exhaust gas can not be recirculated during low load engine operation. This is because, (1) in this type of EGR apparatus the exhaust gas is recirculated by a pressure of the exhaust gas due to the rotation of the engine, and (2) a sufficiently high exhaust gas pressure cannot be formed due to low rotational speed of the engine which is operating under the low load condition.

The above-mentioned second type of EGR apparatus, in which the exhaust gas is recirculated into the intake system at the position downstream of the throttle valve, suffers from the shortcoming that a sufficient amount of exhaust gas cannot be recirculated during high load engine operation in which the throttle opening is large. This is because, (1) in this type of EGR apparatus the exhaust gas is recirculated by a suctional force due to engine vacuum formed downstream of the throttle valve, and (2) a sufficiently large level of vacuum cannot be formed during the high load engine operation due to the large throttle opening.

SUMMARY OF THE INVENTION

An object of the invention is to provide an exhaust gas recirculation apparatus capable of overcoming the above-mentioned shortcomings.

Another object of the invention is to provide an exhaust gas recirculation apparatus by which a sufficient amount of exhaust gas can be recirculated during all engine operating conditions.

Still another object of the invention is to provide an exhaust gas recirculation apparatus in which the exhaust gas is recirculated into the engine intake system at a position upstream of the throttle valve or at a position downstream of the throttle valve in accordance with engine operating conditions.

According to the present invention, an exhaust gas recirculation apparatus for an internal combustion engine is provided, comprising:

a vacuum operated flow control valve having an inlet and an outlet, said valve being adapted for controlling the amount of exhaust gas to be recirculated from said outlet to said inlet in accordance with a vacuum level formed in the intake system of the engine;

a first pipe adapted for connecting said inlet of the flow control valve with the exhaust system of the engine in order to introduce the exhaust gas in the exhaust pipe into said inlet, and;

means for selectively forming, in accordance with engine operating conditions, a first recirculation passageway connecting the outlet of the flow control valve with the intake system at a location situated upstream of the throttle valve of the engine and a second recirculation passageway conncting said outlet with the intake system at a location situated downstream of the throttle valve, whereby the exhaust gas from the flow control valve is introduced into the intake system through one of said first and second recirculation passageways in accordance with engine operating conditions for recirculating a sufficient amount of exhaust gas.

DESCRIPTION OF PREFERRED EMBODIMENTS

Figure 1:
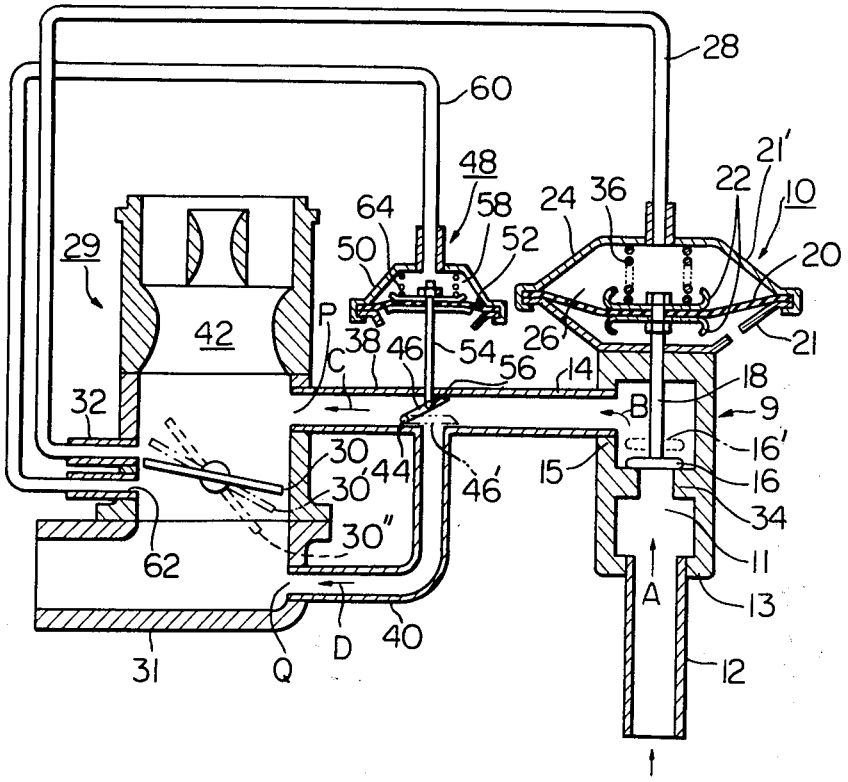
FIG. 1 is a schematic view showing an EGR apparatus according to the first embodiment of the invention.

In FIG. 1, showing a first embodiment of an exhaust gas recirculation apparatus according to the present invention, numeral 10 designates an exhaust gas recirculation (EGR) valve adapted for controlling the amount of exhaust gas to be recirculated. The EGR valve 10 has a body 9 forming a chamber 11 provided with an inlet 13 and an outlet 15. The inlet 13 is connected to a not shown exhaust manifold of the engine, via a recirculation pipe 12, in order to introduce a part of the exhaust gas into the chamber 11 as shown by an arrow A. The outlet 15 is connected to an intake system of the engine including a carburetor 29 and a intake manifold 31 connected thereto as will be fully described later. A valve member 16 is arranged in the chamber 11 so as to face a valve seat 34 formed on an inner wall of the body 9 across the chamber 11. The valve member 16 is connected to one end of a rod 18 which is slidably supported on the body 9. Another end of the rod 18 is, by a set of plates 22, secured to a diaphragm 20 arranged between a lower case 21 secured to the body 9 and an upper case 21' secured to the lower case. A vacuum chamber 26 is, thus, formed on one side of the diaphragm 21 opposite to the body 9. A spring 36 is arranged in the chamber 26 so as to cause the diaphragm 20 to be urged downwardly. The chamber 26 communicates, via a vacuum tube 28, with a vacuum port 32 (a so called EGR port). The EGR port 32 is formed in the carburetor 29 at a position located slightly above the fully closed position of a throttle valve 30 of the carburetor 29, as shown in FIG. 1. When the throttle valve 30 is opened so that one end thereof is located above the EGR port 32, a vacuum signal is transmitted to the chamber 26 in accordance with level of the vacuum signal, in order to move the diaphragm 20 away from the body 9. This causes the valve member 16 to be moved away from the valve seat 34. As a result of this the exhaust gas from the inlet 13 is directed to the outlet 15 as shown by an arrow B.

According to the present invention, one end of a pipe 14 is connected to the outlet 15 of the EGR valve 10. The other end of the pipe 14, on the one hand, is connected to the carburetor 29 at a position P, located upstream of the throttle valve 30, via a pipe 38, in order to recirculate the exhaust gas as shown by an arrow C, and; on the other hand, is connected to the intake manifold 31 at a position Q, located downstream of the throttle valve 30, via a pipe 40, in order to recirculate the exhaust gas as shown by an arrow D. Adjacent to the other end of the pipe 14 a switching valve member 46 is rotatably mounted about a pin 44. The valve member 46 is capable of being pivoted between an upper position, in which it is fully rotated in a counterclockwise direction in FIG. 1, so as to permit communication between the pipes 14 and 40 and a lower position, in which it is fully rotated in a clockwise direction, so as to permit communication between the pipes 14 and 38. The switching of the valve member 46 between the upper and the lower positions is effected by a vacuum actuator 48. The vacuum actuator 48 comprises a diaphragm 52 arranged across the interior of a case 50 so as to form a vacuum chamber 58 on one side of the diaphragm 52. The diaphragm 52, which is downwardly urged by a spring 64, is connected to an upper end of a rod 54. A lower end of the rod 54 is pivoted to the valve member 46 by a pin 56. The chamber 58 is connected to a vacuum port 62 located below the throttle valve 30 via a vacuum signal pipe 60, in order to introduce to the chamber 58 vacuum signals indicating engine operating conditions.

The exhaust gas recirculation apparatus described in FIG. 1 operates as follows.

Low Load Operation

When the engine is operating under a low load in which the throttle valve 30 is rotated as shown by a phantom line 30', so that one end thereof is located slightly above the EGR port 32, the vacuum level at the port 62 below the EGR port 32 is large enough to displace the diaphragm 52 of the actuator 48 upwardly against the force of the spring 64. Therefore, the switching valve member 46 is rotated toward the upper position in the counterclockwise direction about the pin 44 so as to permit communication between the pipes 14 and 40. In this low load operation the vacuum level at the EGR port 32 is large enough to displace the diaphragm 20 of the EGR valve 10 upwardly against the force of the spring 36, causing the valve member 16 to be detached from the valve seat 34 as shown by a phantom line 6'. As a result of this, a recirculation passageway, comprised of the pipe 12, the chamber 11, the pipe 14 and the pipe 40 is formed in order to recirculate an amount of exhaust gas from the not shown exhaust manifold into the intake manifold 31 as shown by the arrows A, B and D. In this low load operation, since the vacuum level in the intake manifold 31 near the position Q is sufficiently large due to the small throttle opening as shown by the dotted line 30', a sufficient amount of the exhaust gas can be "sucked", under the action of a vacuum of large level in the intake manifold 31 located downstream of the throttle valve 30, into the intake manifold 31 at the position Q via the pipe 40 as shown by the arrow D.

High Load Operation

When the engine is operating under a high load, in which the throttle valve 30 is rotated as shown by a dotted line 30'', the vacuum level at the port 62 become small. Therefore the switching valve member 46 is rotated in the clockwise direction to the lower position, as shown by a dotted line 46', so as to permit communication between the pipes 14 and 38. In this high load operation the level of vacuum at the EGR port 32 is decreased when compared to the low load operation. However, the force of the spring 36 of the EGR valve 10 is so determined that the diaphragm 20 is displaced upwardly against the force of the spring 36 by said decreased vacuum, causing the valve member 16 to be detached from the valve seat 34 as shown by the phantom line 16'. As a result of this, another recirculation passageway, comprised of the pipe 12, the chamber 11, the pipe 14 and the pipe 38 is formed, in order to recirculate an amount of exhaust gas from the not shown exhaust manifold into the carburetor as shown by the arrows A, B and C. In this high load operation, since the pressure of the exhaust gas in the exhaust manifold is sufficiently large, due to the large engine rotational speed due to the engine high load, a sufficient amount of exhaust gas can be "pushed" into the carburetor 29 at the position P via the pipe 38 as shown by the arrow C.

As is clear from the above description of the first embodiment in FIG. 1, the exhaust gas can be recirculated from the position P located upstream of the throttle valve as shown by the arrow C when the engine is operating under a high load condition, or from the position Q located downstream of the throttle valve 30 as shown by the arrow D when the engine is operating under a low load condition. Therefore, a sufficient amount of recirculation gas is always maintained for effectively suppressing $NO_x$ emission from the engine.

Figure 2A:
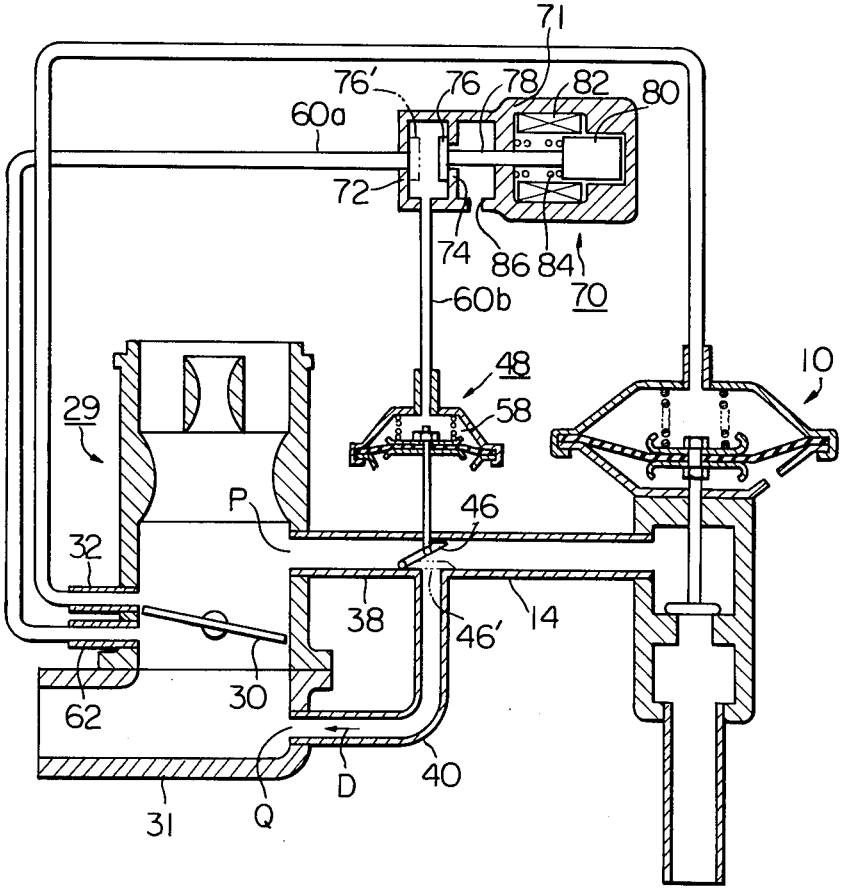
FIG. 2*a* is a schematic view showing another embodiment of the present invention.
Figure 2B:
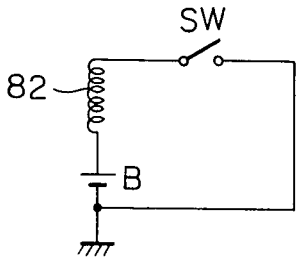
FIG. 2*b* is a electrical circuit for the electromagnetic valve in FIG. 2.

The embodiment shown in FIG. 2*a* is different from the embodiment shown by FIG. 1 in that an electromagnetic valve 70 is provided between vacuum signal pipes 60*a* and 60*b*. This valve 70 operates to open or close communication between the vacuum port 32 and the vacuum chamber 58 of the actuator 48 in accordance with an engine operating condition, for example, engine rotational speed. The electromagnetic valve 70 has a body 71 which forms two valve seats 72 and 74, and has a valve member 76 arranged between the valve seats 72 and 74. The valve member 76 is connected to one end of a rod 78 which has an enlarged diameter portion 80 on its other end. The portion 80 extends out of a solenoid coil 82 of tubular shape arranged in the body 71. A spring 84 urges the portion 80 so that the valve member 76 is rested on the valve seat 74 when the solenoid coil 82 is not energized, in order to communicate the pipe 60*a* with the pipe 60*b* for transmitting a vacuum signal at the port 32 into the chamber 58 of the actuator 48. When the solenoid coil 82 is energized, the portion 80 is moved toward the coil 82 against the force of the spring 84 by the electromagnetic force between the coil 82 and the portion 80, so that the valve member 76 is rested on the valve seat 72 as shown by a phantom line 76'. This prevents the communication of the pipe 60*a* with the pipe 60*b* and opens the chamber 58 of the actuator 48 to the atmosphere via the aperture in the valve seat 74 and an aperture 86 in the body 71. The solenoid coil 82 is, as shown in FIG. 2*b*, connected to a switch SW opened or closed in accordance with the engine operating conditions, and a battery B. As the switch SW, a gear switch may be used, which operates so as to be opened when the transmission gear of the engine is in a low speed range and to be closed when the transmission gear is in ranges other than the low speed range.

In the operation of the second embodiment in FIG.2*a*, when the engine is operating under a low load condition at low engine rotational speed, in which the opening of the throttle valve 30 is small and in which the transmission gear is in its low speed range, the gear switch SW is opened so that the solenoid coil 82 is not energized. This causes the valve member 76 to be rested on the valve seat 74. Thus, a vacuum signal of a large level, due to the small throttle opening, is transmitted to the chamber 58 of the actuator 48 from the port 32 via the pipes 60*a* and 60*b*. As a result of this, switching valve member 46 is rotated in the counterclockwise direction toward the upper position so as to permit the communication of the pipes 14 and 40. Thus, a sufficient amount of exhaust gas can be "sucked", under the vacuum in the manifold 31 located downstream of the throttle valve 30, into the intake manifold 31 at the position Q as shown by the arrow D.

When the engine is operating under a high load operation at high engine rotational speed, in which the transmission gear is in the ranges other than the low speed range, the gear switch SW is closed so that the solenoid coil 82 is energized. This causes the valve member 76 to be rested on the valve seat 72 for preventing the communication between the tubes 60*a* and 60*b*. Thus, the chamber 58 of the actuator 58 is opened to the atmosphere, thereby causing the switching valve member 46 to be rotated in the clockwise direction toward the lower position, as shown by the phantom line 46', for communicating the pipe 14 with the pipe 38. As a result of this a sufficient amount of exhaust gas can be "pushed" into the carburetor 29 at the position P, located upstream of the throttle valve 30, under a high pressure of the exhaust gas due to the high rotational speed of the engine. Since the gear switch SW is used for detecting the engine rotational condition in the embodiment shown in FIG. 2*a*, for moving the valve member 46 between the upper position and the lower position, a sufficient amount of recirculation gas is always obtained during all engine operating conditions.

In place of the gear switch SW, a known type of engine speed sensor may be used, which operates to transform an ignition pulse signal from the distributor of the engine into ON and OFF signals, and which may be connected to the solenoid coil 82 of the valve 70 (FIG. 2*a*). The ON signal is provided when the engine rotational speed is lower than a predetermined valve. In this case the solenoid 82 is not energized. The OFF signal is provided when the engine rotational speed is larger than the predetermined valve to energized the solenoid 82.

Another type of switch, for example, an engine acceleration switch or engine coolant temperature switch, can be used for precisely detecting the engine operating condition at which the switching valve member 46 is to be moved from said upper position to the lower position.

Figure 3:
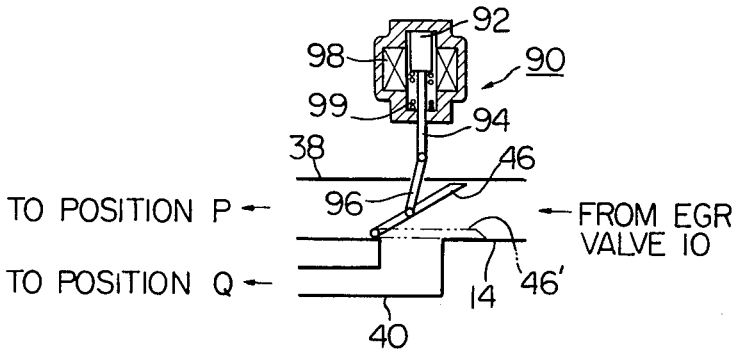
FIG. 3 is a schematic diagram showing still another embodiment of the present invention.

In another embodiment shown in FIG. 3, an electromagnetic actuator 90 is used for moving the valve member 46 between the lower position in which the pipe 14 communicates with the pipe 40 and the upper position in which the pipe 14 communicates with the pipe 38. The actuator 90 has a movable piece 92 inserted into a solenoid coil 98. The piece 92, urged upwardly by a spring 99, has a rod portion 94, which is connected to the switching valve member 46 via a link 96. The solenoid 98 is connected to an electrical circuit which is substantially the same as that described with reference to FIG. 2*b* including the switch SW detecting engine operating conditions, for example, a gear switch.

When the solenoid coil 98 is not energized, the piece 92 is urged upwardly by the spring 99, causing the switching valve member 46 to be moved in the counterclockwise direction toward the upper position in which the pipe 14 communicates with the pipe 40. This causes recirculation of the exhaust gas from the position Q located below the throttle valve. When the solenoid coil 98 is energized, the piece 92 is moved downwardly, by an electromagnetic force between the piece 92 and the solenoid coil 98, causing the switching valve member 46 to be moved in the clockwise direction toward the lower position shown by the phantom line 46'. In this case the pipe 14 communicates with the pipe 38, in order to recirculate the exhaust gas from a position P located above the throttle valve 30.

Figure 4:
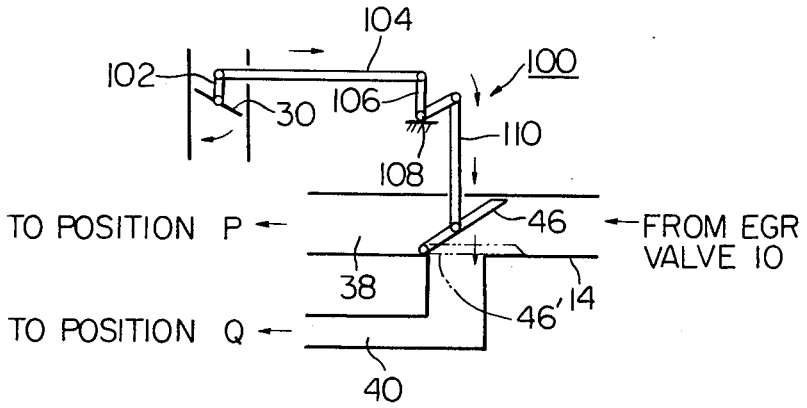
FIG. 4 is a schematic diagram showing a further embodiment of the present invention.

In still another embodiment, shown in FIG. 4, a link and lever mechanism 100 is used for moving the switching valve member 46. The link and lever mechanism 100 has a lever 102 secured to the throttle valve 30, a link 104, a bell crank 106 rotatable about a pin 108 and connected to the lever 102 by the link 104, and a link 110 connecting the bell crank 106 with the switching valve member 46.

In the operation of the embodiment in FIG. 4, when the engine is operating under a low load condition, in which the throttle valve is situated near the fully closed position, the switching valve member is in its upward position so that the pipe 14 communicates with the pipe 40. Thus, a sufficient amount of exhaust gas can be sucked into the intake system at a position Q, under a vacuum of large level due to the small opening of the throttle valve 30. When the throttle valve is sufficiently rotated in the clockwise direction for effecting high load operation, the switching valve member 46 is also rotated in the clockwise direction, by the lever and link mechanism 100, toward the upper position 46', so as to communicate the pipe 14 with the pipe 38. Thus, a sufficient amount of exhaust gas can be pushed into the intake system at the position P, under a high exhaust gas pressure due to the high rotational speed of the engine.

While this invention has been described hereinbefore with reference to particular embodiments, many modifications and changes can be made by those skilled in this art, without departing from the spirit and scope of the invention.

What is claimed is:

1. An exhaust gas recirculation apparatus for an internal combustion engine, comprising:

a vacuum operated flow control valve having an inlet and an outlet, which valve is adapted for controlling the amount of exhaust gas to be recirculated from said inlet to said outlet in accordance with a vacuum level formed in the intake system of the engine;

a first pipe means adapted for connecting said inlet of the flow control valve with the exhaust system of the engine in order to introduce the exhaust gas in the exhaust gas pipe into said inlet;

second pipe means, one end of which is connected to the outlet of the flow control valve;

third pipe means adapted for connection of another end of the second pipe means with the intake system at the location situated upstream of the throttle valve;

a fourth pipe means adapted for connection of said other end of the second pipe means with the intake system at the location situated downstream of the throttle valve;

a switching valve member arranged adjacent to said other end of the third pipe means, which member is capable of being moved between a first position in which said second pipe means communicates with said third pipe means in order to form said first recirculation passageway connecting the outlet of the flow control valve with the intake system at the location upstream of the throttle valve, and a second position in which said second pipe means communicates with said fourth pipe means in order to form said second recirculation passageway connecting the outlet of the flow control valve with the intake system at the location downstream of the throttle valve, and;

operating means to move said switching valve member between said first and said second positions in accordance with engine operating conditions.

2. An exhaust gas recirculation apparatus for an internal combustion engine, comprising:

a vacuum operated flow control valve having an inlet and an outlet, which valve is adapted for controlling the amount of exhaust gas to be recirculated from said inlet to said outlet in accordance with a vacuum level formed in the intake system of the engine;

a first pipe means adapted for connecting said inlet of the flow control valve with the exhaust system of the engine in order to introduce the exhaust gas in the exhaust pipe into said inlet;

second pipe means, one end of which is connected to the outlet of the flow control valve;

third pipe means adapted for connection of another end of the second pipe means with the intake system at the location situated upstream of the throttle valve;

a fourth pipe means adapted for connection of said other end of the second pipe means with the intake system at the location situated downstream of the throttle valve;

a switching valve member arranged adjacent to said other end of the third pipe means, which member is capable of being moved between a first position in which said second pipe means communicates with said third pipe means in order to form said first recirculation passageway connecting the outlet of the flow control valve with the intake system at the location upstream of the throttle valve, and a second position in which said second pipe means communicates with said fourth pipe means in order to form said second recirculation passageway connecting the outlet of the flow control valve with the intake system at the location downstream of the throttle valve;

operating means to move said switching valve member between said first and second positions in accordance with engine operating conditions comprising a vacuum actuator having a spring urged diaphragm which is, on one side, mechanically connected to said switching valve member and which defines in part, on the other side a vacuum chamber which is, via a vacuum signal pipe, connected to a vacuum port formed in the intake system situated downstream of the throttle valve, so that vacuum signals indicating the operating conditions of the engine are transmitted to said vacuum chamber, thereby causing the switching valve member to be moved between said first position and said second position by means of said diaphragm in accordance with said vacuum signals.

3. An exhaust gas recirculation apparatus according to claim 2, wherein it further comprises vacuum control valve means arranged on said vacuum signal pipe means for communicating the vacuum chamber with said vacuum signal port only when the engine is operating under particular operating conditions, whereby the transmission of the vacuum signals, to said vacuum chamber during said particular operating conditions is prevented.

4. An exhaust gas recirculation apparatus according to claim 2, wherein said operating means comprises an electromagnetic actuator mechanically connected to said switching valve member, which actuator is adapted for moving said switching valve member between said first and second positions in accordance with said engine operating conditions.

5. An exhaust gas recirculation apparatus according to claim 2, wherein said operating means comprises a link and lever mechanism which mechanically connects the throttle valve of the engine with said switching valve member, so that said switching valve member is moved between said first position and said second position in accordance with the pivotal movement said throttle valve.

* * * * *